US009549605B2

(12) United States Patent
Danelski

(10) Patent No.: US 9,549,605 B2
(45) Date of Patent: Jan. 24, 2017

(54) LIQUID CONTAINER

(71) Applicant: Paul Danelski, Apple Valley, MN (US)

(72) Inventor: Paul Danelski, Apple Valley, MN (US)

( * ) Notice: Subject to any disclaimer, the term of this patent is extended or adjusted under 35 U.S.C. 154(b) by 0 days.

(21) Appl. No.: 14/328,165

(22) Filed: Jul. 10, 2014

(65) Prior Publication Data

US 2015/0014338 A1 Jan. 15, 2015

Related U.S. Application Data

(60) Provisional application No. 61/844,953, filed on Jul. 11, 2013.

(51) Int. Cl.
*A45F 3/18* (2006.01)
*A47G 23/02* (2006.01)

(52) U.S. Cl.
CPC ..... *A45F 3/18* (2013.01); *A47G 23/0266* (2013.01)

(58) Field of Classification Search
CPC ..... A45F 3/18; A47G 23/0266
USPC ..... 220/703, 711, 714, 202, 203.01, 203.04,220/203.07, 303; 215/260
See application file for complete search history.

(56) References Cited

U.S. PATENT DOCUMENTS

| | | | | |
|---|---|---|---|---|
| 560,196 | A | 5/1896 | McDonough | |
| 1,280,942 | A | 10/1918 | Apple | |
| 1,403,148 | A | 1/1922 | Coleridge | |
| 4,388,996 | A | 6/1983 | Panicci | |
| 4,949,883 | A * | 8/1990 | Dubach | 222/556 |
| 5,588,548 | A | 12/1996 | Brankley | |
| 5,702,025 | A | 12/1997 | Di Gregorio | |
| 6,079,589 | A * | 6/2000 | Matsuyama et al. | 220/715 |
| 6,290,108 | B1 * | 9/2001 | Gross | 222/494 |
| 7,134,570 | B1 | 11/2006 | Heath et al. | |
| 7,530,466 | B2 | 5/2009 | Spinelli et al. | |
| 7,533,783 | B2 | 5/2009 | Choi et al. | |
| D625,830 | S | 10/2010 | Py et al. | |
| 8,636,166 | B2 | 1/2014 | Lane | |
| D699,175 | S * | 2/2014 | Lombard | D12/420 |
| 2005/0178774 | A1 * | 8/2005 | Howell | A47G 19/2227 220/703 |
| 2006/0180585 | A1 * | 8/2006 | Cunningham | A47G 19/2266 220/203.06 |
| 2006/0201902 | A1 * | 9/2006 | Brown et al. | 215/11.4 |
| 2009/0139995 | A1 | 6/2009 | Py et al. | |
| 2009/0272742 | A1 | 11/2009 | Dybala | |
| 2012/0104063 | A1 * | 5/2012 | Sweigart | 224/414 |

* cited by examiner

*Primary Examiner* — Robert J Hicks
*Assistant Examiner* — Kareen Thomas
(74) *Attorney, Agent, or Firm* — Brian E. Szymanski

(57) ABSTRACT

A cap that is suitable for use on conventional liquid containers, particularly water bottles for recreational use. The cap includes a release mechanism for dispensing liquids. The release mechanism is at an angle from the vertical axis of the cap.

9 Claims, 7 Drawing Sheets

LIQUID CONTAINER

This application claims priority to U.S. Provisional Patent Application No. 61/844,953 filed Jul. 11, 2013, the disclosure of each are herein incorporated by reference in its entirety.

TECHNICAL FIELD

A cap for a conventional liquid retaining bottle suitable for use in recreational activities. The cap enables safe use and application during the physical activities, such as cycling.

BACKGROUND

Bicycling and other recreational activities often employ the use of water bottles that retain water or other fluids and selectively dispense such fluids upon pressure or related activity initiated by the end user. The conventional bottles often use some form of release valve that prevents dispensing until desired by the user. These valves often are mechanical valves or a pressure relief based valves that are capable of dispensing upon a selected force or action.

It is a common practice among both recreational and professional cyclist to drink out of a water bottle during cycling activity. This action will of course require the cyclist to take their eyes and attention from the road, path or trail upon which they are traveling. The consequences, particularly at elevated speeds can be detrimental to the rider. Many crashes have been caused by a rider's attention being diverted, particularly during group riding activities. In part, the standard water bottle valve is nominally in an upright position extending along the vertical axis of the water bottle or container. This position of the valve requires the rider to extend or move their head upward to enable the dispensing and ingestion of the liquid. This is particularly true as the water bottle contains limited amount of fluid as it empties. The movement of the head into an upward angle necessarily diverts the rider's eyes in the same direction, thereby creating a potentially unsafe situation because the rider's eyes are not focused on the direction that they are heading.

SUMMARY

Embodiments of the cap set forth in this disclosure are suitable for use on conventional liquid containers, particularly water bottles that are capable of holding commercially available beverage containers. The cap includes a release mechanism for dispensing liquids at an angle from the vertical axis of the cap. The angled release mechanism enables the ingestion of the fluid without requiring an individual to substantially tilt their head. This use of the cap will prevent users, such as cyclists, from taking their eyes and attention from the road, path or trail upon which they are traveling.

DETAILED DESCRIPTION

Figure 1A:
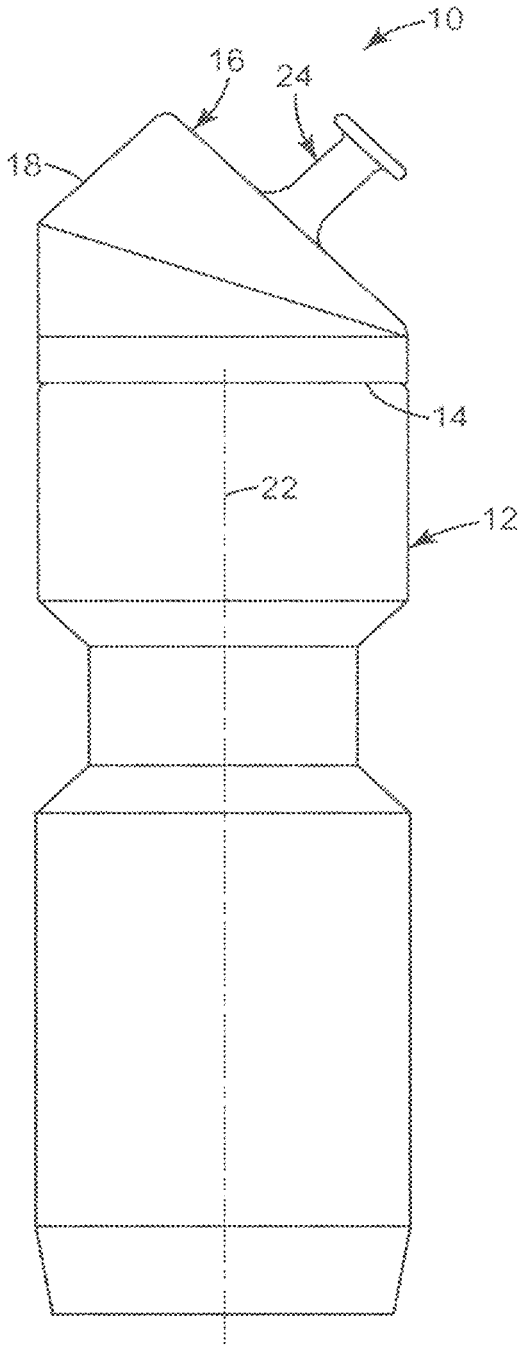
FIGS. 1(*a-e*) are schematics of one embodiment of the cap with a conventional receptacle.
Figure 1B:
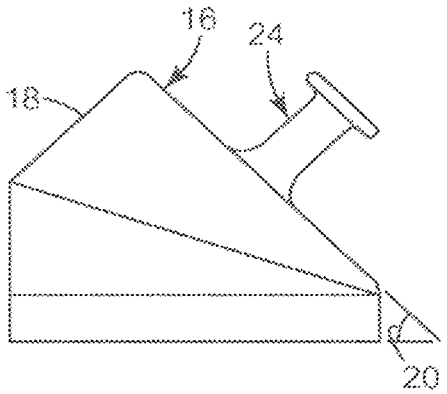
Figure 1C:
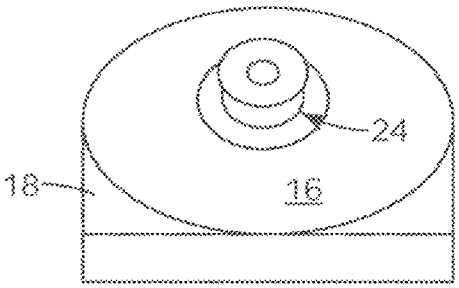
Figure 1D:
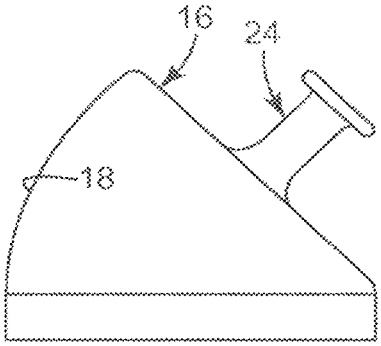
Figure 1E:
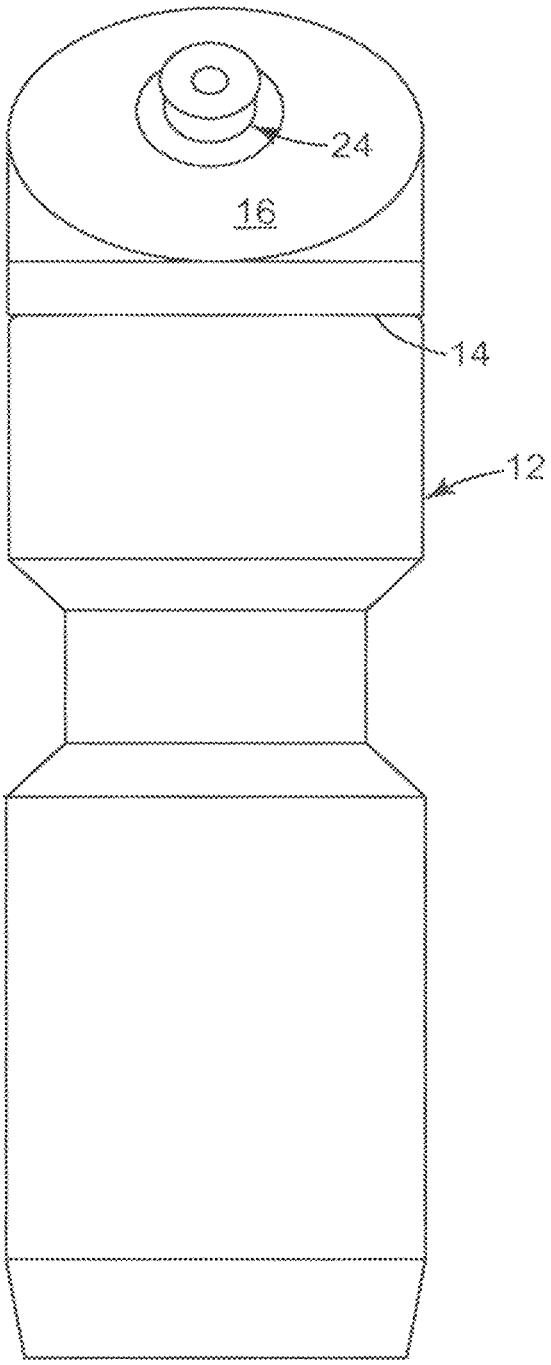

In FIGS. 1 (*a-e*) is an embodiment of the cap 10 in conjunction with a conventional water bottle 12. The cap includes a mating surface 14 and reservoir 16. The reservoir 16 has a release mechanism 24 extending outward. The mating surface 14 has a mating mechanism (not shown) that connects with a counterpart mating mechanism (not shown) on the water bottle 12. In one embodiment, the radial sides 18 of the cap 10 are molded so that at least a portion of the sides are shorter on one side of the cap 10 than the other. This creates an angle 20 that offsets the release mechanism 24 from a position perpendicular to the vertical axis 22 of the cap 10 and water bottle 12. The release mechanism 24 generally dispenses liquid from the water bottle 12.

Figure 2A:
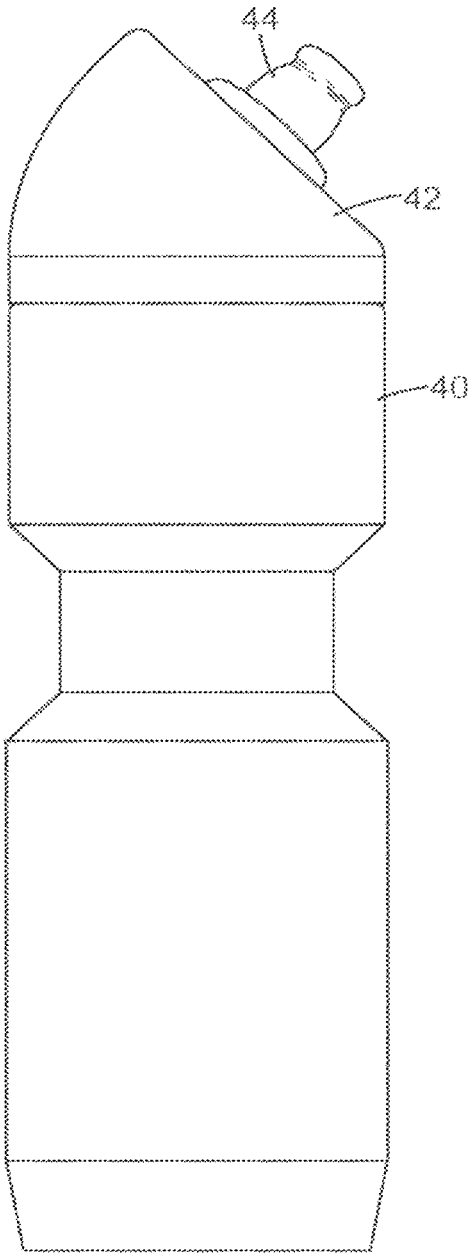
FIGS. 2(*a-b*) is a pictorial version of a cap of the disclosure with a commercially available water bottle.
Figure 2B:
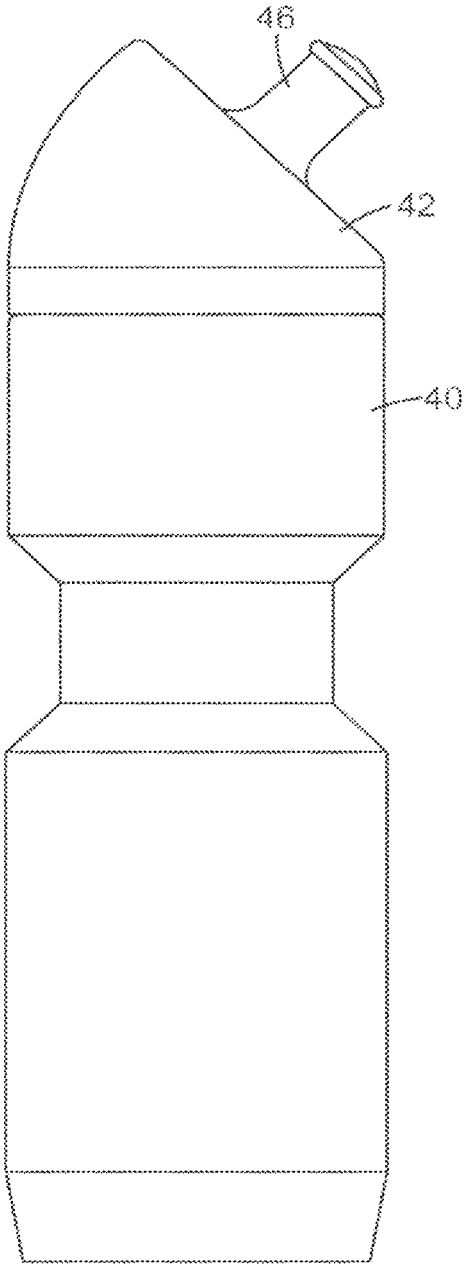
Figure 3A:
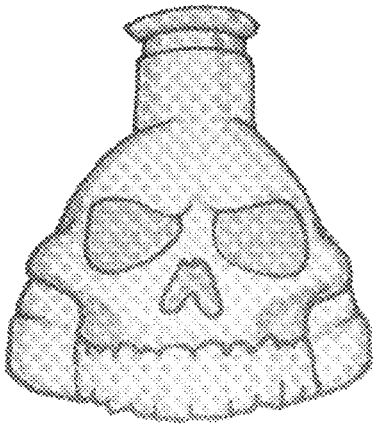
FIGS. 3(*a-d*) depict indicia and fanciful art on other embodiments of the cap.
Figure 3B:
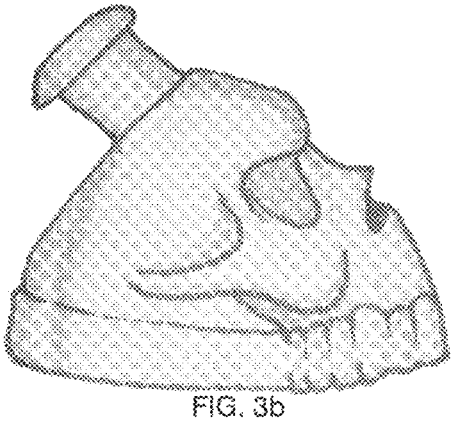
Figure 3C:
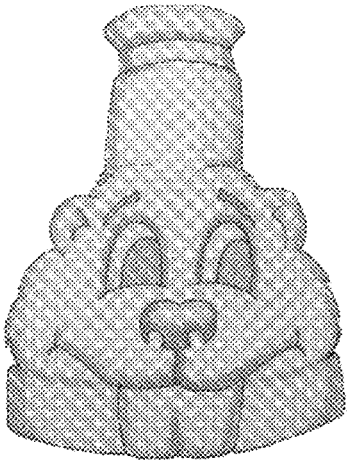
Figure 3D:
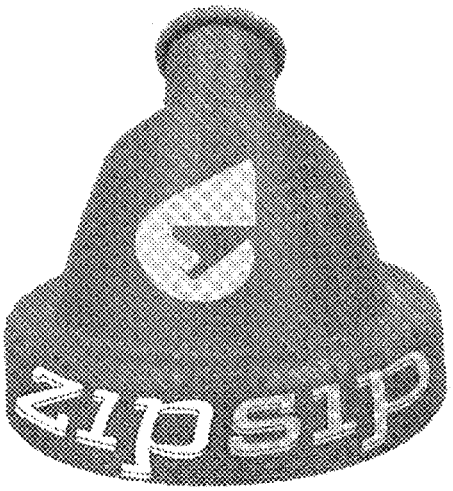

FIG. 2*a* depicts an embodiment using a commercially available water bottle 40 and one form of cap 42. A pressure release style releasing mechanism 44 is shown extending from the cap 42 and angle distinct from the vertical axis of the water bottle. FIG. 2*b* illustrates an embodiment using a mechanical release mechanism 46 on the cap 42.

The removable cap with the angled valve or release mechanism is generally designed to prevent the user from tilting their head back, and eyes upward, in order to ingest fluid from the container. This is well suited for uses such as cycling where such a diversion may have very adverse consequences. Use of the embodiments disclosed herein enable the discharge of fluid where the container is angled yet the valve or release mechanism remains at a substantially horizontal position, thereby leaving the user's line of vision in a substantially horizontal plane.

In one embodiment, the removable cap is suitable for positioning on a receptacle capable of holding liquids. When engaged with the receptacle, the removable top is capable of forming a closure for the receptacle thereby retaining liquid or fluids in the receptacle. The cap has a reservoir with a surface. The release mechanism extends from the surface of the reservoir such that is not substantially perpendicular to a vertical axis of the receptacle. The surface has a release mechanism for selectively dispensing liquid from the receptacle through the release mechanism. The release mechanism is in a position that is non-perpendicular to the vertical axis of the receptacle, as exemplified in FIGS. 1 and 2.

In certain embodiments, the angle of the release mechanism is determined based upon a horizontal axis or plane of the cap and a vertical axis or plane of the cap. Those of ordinary skill in the art recognize that the angle may be selected to optimally place the release mechanism in a position well suited for the intended activity or in a position so that it does not interfere with the intended receptacle. In some embodiments, the angle of the release valve as measured from a horizontal plane of the cap and a vertical plane of the cap is about 5 degrees to about 85 degrees. In other embodiments, the angle of the release valve may be about 10 degrees to about 80 degrees, and yet in further embodiments, the angle of the release valve may be about 15 degrees to about 75 degrees. In embodiments for certain applications, such as cycling, for example, an angle of about 30 degrees to about 60 degrees is very suitable.

In another embodiment, the removable cap is capable of forming a closure for the receptacle in order to retain liquids therein. The cap has a radial side surface and a top surface integrally formed with the radial side surface. At least a portion of the radial side surface is not equivalent in length to a remaining portion of the radial side surface. This results in a top surface positioned at an angle from the vertical axis of the receptacle. The top surface has a release mechanism extending therefrom for selectively dispensing liquid from the receptacle through the release mechanism.

In yet another embodiment, a receptacle, capable of holding liquids, has an open end suitable for accepting fluids. The open end has a mating mechanism. The mating mechanism is substantially perpendicular to a vertical axis of the receptacle. A removable cap has a mating end with its own mating mechanism. The mating mechanism of the cap is capable of mating with the counterpart mating mechanism of the receptacle. When mated, they form a closed system for retaining liquid in the receptacle. The removable cap has a radial side surface and a top surface integrally formed with the radial side surface. The plane corresponding to the mating end of the cap and the top surface forming an angle of greater than 5 degrees but less than 90 degrees. In some embodiments, the angle may be greater than 30 degrees. The top surface also has a release mechanism extending therefrom for selectively dispensing liquid from the receptacle.

In all of the embodiments, there are optional aspects that may vary depending upon the desired end use application. For example, the closure or mating surfaces may be threaded closures or alternatively snap fit closures. In other embodiment, it may be desirable to have the valve or release mechanism not extend beyond the sides of the receptacle or water bottle. This may prevent the valve from inadvertently interfering with the user or catching on another article or object.

One advantage of certain embodiments is the ergonomic features enabled by the angled release mechanism. The angled release mechanism may prevent over extension of the head and neck of an individual. Over extension or straining motions by an individual during or after a vigorous physical activity could potentially lead to vertigo of dizziness with very adverse results. The angled release mechanism can prevent such problems.

The caps, and the other components of the cap, may be made using conventional plastics suitable for food grade applications. Those of ordinary skill in the art are capable of selecting proper materials for desired end use applications. Additionally, conventional polymer molding and assembly processes may be utilized to produce the caps according to this disclosure.

In another embodiment, indicia or fanciful art or renderings may be applied onto a portion of the cap. In some embodiments, such indicia or fanciful art is placed on the exposed portion of the cap with the greatest available area. FIGS. 3(*a-d*) depict several embodiments of fanciful art and indicia on the removable cap. The indicia and fanciful art may be molded with the formation process of the removable cap. Alternatively, the indicia or fanciful art may be printed onto the cap utilizing various techniques conventionally recognized in the art.

In another embodiment, the removable cap of this disclosure is suitable for positioning on a receptacle that is capable of holding a liquid container, such as for example, a beverage can. The cap engages a surface of the liquid container and forms a substantially closed system for retaining fluids. The cap has a compression ring, formed internal to the second mating mechanism of the cap, that effectively engages the liquid container. The compression ring may be made of a elastomeric material and may even be integrally formed into the cap. The liquid container, the removable cap and the compression ring form a closed system for retaining liquid between the liquid container and the fluid reservoir. This embodiment permits the user to insert commercial beverages into the receptacle for periodic consumption during an intended activity.

The receptacle may be designed to accommodate standard, commercially available beverages, such as those sold in cans, while still being capable of fitting into a standard water bottle cage, for example during cycling. This approach may provide insulating properties to reduce the heat transfer from a chilled fluid in the liquid container. The liquid container may be easily removed from the receptacle once the liquid container is emptied by removing the cap from the receptacle and then removing the liquid container.

Figure 4A:
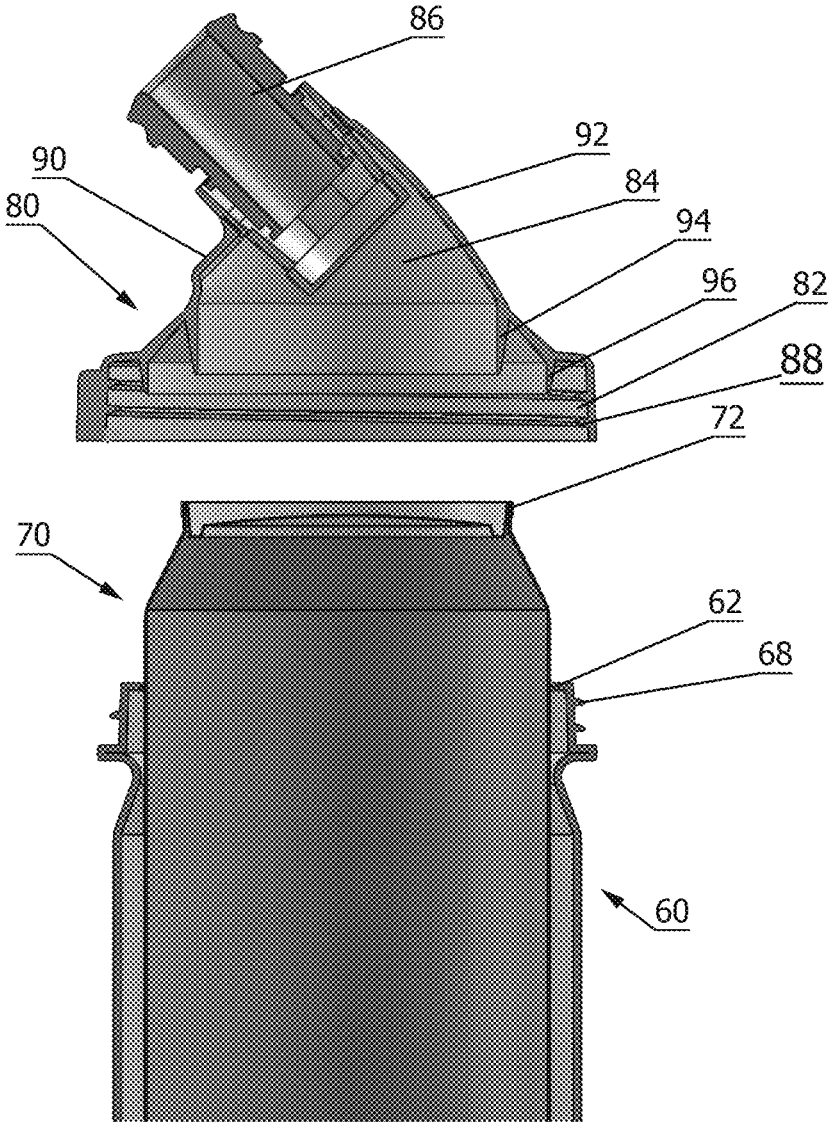
FIGS. 4*a-c* illustrate an embodiment suitable for holding a liquid container.
Figure 4B:
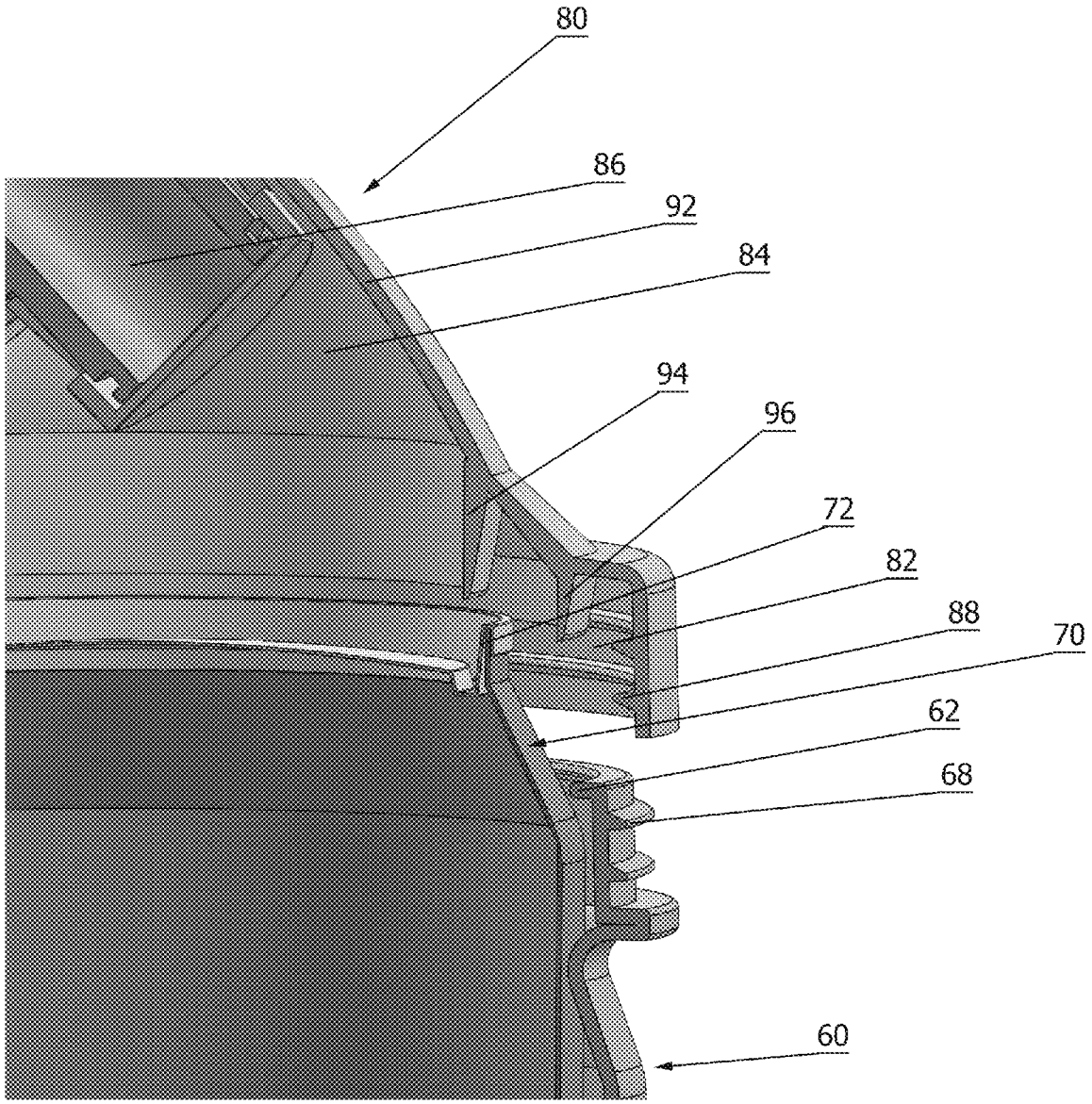
Figure 4C:
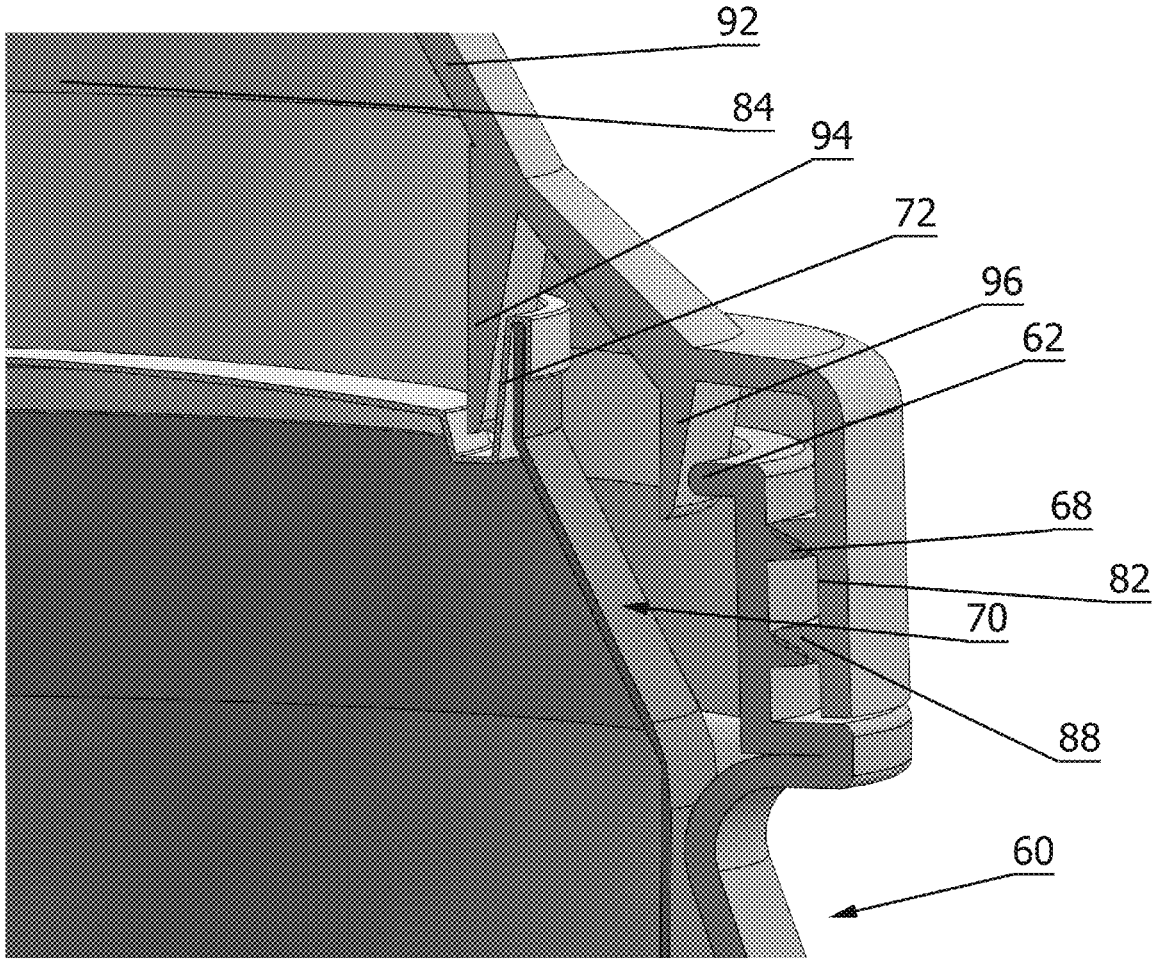

FIGS. 4*a-c* depict sectional views of an embodiment for holding a liquid container in the receptacle with the removable cap providing a sealing function over both the liquid container and the receptacle. FIG. 4*a* illustrates the embodiment with the distinct elements separated prior to an operating configuration. FIG. 4*b* illustrates a partial configuration with the incomplete mating of elements. FIG. 4*c* demonstrates the embodiment when all elements are in a full communication for an operating configuration. A receptacle 60 holds a liquid container 70 with a removable cap 80 placed over the receptacle 60. The removable cap 80 includes a mating surface 82 and reservoir 84. The reservoir 84 has a release mechanism 86 extending outward. The mating surface 82 has a mating mechanism 88 (mechanical threads) that connects with a counterpart mating surface 62 having a mating mechanism 68 (mechanical threads) on the receptacle 60. In one embodiment, the radial sides 90, 92 of the cap 80 are molded so that at least a portion of the sides are shorter on one side of the cap 80 than the other. The removable cap 80 possesses a compression ring 94 that engages a top surface 72 of liquid container 70. A second compression ring 96 engages a surface 64 of the receptacle 60. The compression rings 94 and 96 and form a substantially closed system for retaining fluids in the liquid container and the reservoir 84. A release mechanism 86 generally dispenses liquid from the reservoir 84.

What is claimed is:

1. An article comprising:

(a) a receptacle capable of holding liquids, the receptacle having an open end, the open end having a first mating mechanism, wherein the mating mechanism is substantially perpendicular to a vertical axis of the receptacle, and (b) a removable cap with (i) a second mating mechanism on a mating end of the cap, the second mating mechanism capable of mating with the first mating mechanism of the receptacle, (ii) a compression ring formed internal to the second mating mechanism, the compression ring suitable for engaging a liquid container placed in the receptacle, and (iii) a fluid reservoir with a surface, the surface possessing a release mechanism for selectively dispensing liquid from the receptacle through the release mechanism, wherein the liquid container, the removable cap and the compression ring form a closed system for retaining liquid between the liquid container and the fluid reservoir.

2. An article according to claim 1, wherein the release mechanism is in a position at an angle of about 10 degrees to about 80 degrees as measured from a horizontal plane of the mating end of the cap to a vertical plane of the cap.

3. An article according to claim 1, wherein the release mechanism is in a position at an angle of about 15 degrees to about 75 degrees as measured from a horizontal plane of the mating end of the cap to a vertical plane of the cap.

4. An article according to claim 1, wherein the release mechanism is a pressure release valve or a mechanical valve.

5. An article according to claim 1, wherein the first mating mechanism and the second mating mechanism comprise a threaded closure or snap fit closure.

6. An article according to claim 1, further comprising indicia or fanciful art on the removable cap.

7. An article according to claim 6, wherein the indicia or fanciful art is molded into the removable cap or printed onto the removable cap.

8. An article according to claim 1, wherein the liquid container is a beverage can.

9. An article according to claim 1, wherein the compression ring is made of an elastomeric material.

* * * * *